US006121221A

United States Patent [19]

Davis

[11] Patent Number: 6,121,221

[45] Date of Patent: Sep. 19, 2000

[54] KIT FOR CLEANING VINYL PLASTICS

[75] Inventor: Ronald O. Davis, 308 Firebridge Rd., Columbia, S.C. 29223

[73] Assignee: Ronald O. Davis, Columbia, S.C.

[21] Appl. No.: 09/359,864

[22] Filed: Jul. 26, 1999

[51] Int. Cl.[7] ..... C11D 7/50; C11D 17/04

[52] U.S. Cl. ..... 510/244; 510/394; 510/406; 510/407; 510/505

[58] Field of Search ..... 510/244, 394, 510/406, 407, 505

[56] References Cited

U.S. PATENT DOCUMENTS

| | | | |
|---|---|---|---|
| 3,660,125 | 5/1972 | Buell . | |
| 3,791,845 | 2/1974 | Tuite . | |
| 3,922,232 | 11/1975 | Schein . | |
| 3,994,751 | 11/1976 | Ingram | 510/254 |
| 4,460,374 | 7/1984 | Abel et al. . | |
| 4,716,056 | 12/1987 | Fox et al. | 427/407.1 |
| 4,741,860 | 5/1988 | Hartman . | |
| 4,801,397 | 1/1989 | Flanagan et al. | 510/202 |
| 4,945,121 | 7/1990 | Micale et al. . | |
| 4,983,466 | 1/1991 | Witman | 428/483 |
| 5,064,570 | 11/1991 | Rohringer . | |
| 5,094,777 | 3/1992 | Dipietro . | |
| 5,401,438 | 3/1995 | Otsuka . | |
| 5,599,783 | 2/1997 | Ide et al. | 510/412 |
| 5,643,703 | 7/1997 | Diamond et al. | 430/78 |
| 5,646,207 | 7/1997 | Schell . | |
| 5,759,975 | 6/1998 | Maxwell | 510/203 |
| 5,785,766 | 7/1998 | Davis . | |

FOREIGN PATENT DOCUMENTS

| | | |
|---|---|---|
| 232324 | 12/1960 | Australia . |
| 601271 | 6/1960 | Canada . |
| 0265041 | 4/1988 | European Pat. Off. . |
| 1282592 | 11/1968 | Germany . |
| 44-18958 | 8/1969 | Japan . |
| 61-268798 | 11/1986 | Japan . |
| 84/00769 | 3/1984 | WIPO . |
| 96/23041 | 8/1996 | WIPO . |

*Primary Examiner*—Lorna M. Douyon
*Attorney, Agent, or Firm*—Michael A. Mann; Michael E. Wever; Nexsen, Pruet, Jacobs & Pollard

[57] ABSTRACT

A kit for cleaning vinyl plastics containing a mixture of solvents and a fluorescent material in a first container, a solvent and a fluorescent material in a second container, and, optionally a cloth and a detergent. The mixture of solvents in the first container is used to remove film from the vinyl plastics and includes 55% isopropyl alcohol, 40% methyl ethyl ketone, and 5% xylene. The second container contains a coating to be applied to white vinyl plastics to brighten them. The detergent is used to remove loose dirt and grime. The cloth is used to apply the mixtures in the two containers.

19 Claims, 1 Drawing Sheet

KIT FOR CLEANING VINYL PLASTICS

FIELD OF THE INVENTION

The present invention is kit for cleaning vinyl plastics.

DESCRIPTION OF PRIOR ART

Vinyl plastics have achieved wide commercial acceptance for numerous utilities because they are strong, light weight, easy to manufacture, and relatively inexpensive. Despite this commercial success, vinyl plastics still have numerous characteristic flaws. One of these is its susceptibility to discoloration or yellowing due to time or weathering. Significant effort has been expended in the art to counteract this disadvantage; yet only limited success has been achieved.

Fluorescent optical whiteners, per se, are known in the art. U.S. Pat. No. 4,460,374, issued Jul. 17, 1984 to Heinz Abel et al. describes compositions for treating textiles which includes an organic solvent, a solid or liquid vehicle dissolved in the solvent, and an insoluble or sparingly soluble finishing agent. The finishing agent may include fluorescent whitening agents. Canadian Patent No. 601,271, issued Jul. 5, 1960 to Earl C. Gifford et al. describes soluble compositions of coumarin brighteners.

Combinations of optical brighteners or fluorescent brighteners with bleaches have also been proposed. For example, Australian Patent Specification Serial No. 232324, published Mar. 5, 1959 and assigned to Geoffrey Sly describes solid compositions for treating cellulosic fibrous materials that include a solid chemical bleach and a benzothiophene dioxide optical brightener. European Patent Application Publication No. 265,041 (A2), published Apr. 27, 1988 and assigned to The Clorox Company describes a thickening system for laundry products that includes a fluorescent whitening agent or dye, a surfactant, and an acidic pH adjusting agent, suitable for formulation with peroxide bleaches.

Optical or fluorescent brighteners have been used in coating compositions. U.S. Pat. No. 4,741,860, issued May 3, 1988 to Marvis E. Hartman describes detectable adhesion promoting compositions that include a chlorinated polyolefin and an optical brightener. U.S. Pat. No. 5,064,570, issued Nov. 12, 1991 to Peter Rohringer describes a dispersions of fluorescent brighteners and water-insoluble fatty alcohol 50 auxiliaries in coating compositions. U.S. Pat. No. 5,401,438, issued Mar. 28, 1995 to Masahiro Otsuka describes an indole compound which is useful as a UV light absorbing additive or an anti-halation additive for colored resin compositions, resin films, heat-sensitive recording materials, liquid crystal display materials and the like.

Bleaching of polymeric substrates with optical brighteners has been explored in the prior art. German Patent No. 1,282,592, published Nov. 15, 1968 and assigned to Farbwerke Hoechst Aktiengesellschaft describes optical brighteners for polyamides, polyesters, vinyl chloride polymers, and the like, that include a yellow benzoxazole compound with reddish to greenish blue fluorescence. Japanese Patent 44-18958, published Aug. 18, 1969 and assigned to Mitsubishi Chem. Inds. Ltd. describes optically bleaching polyamide type moldings with acylarninocumarine fluorescent agents.

None of the above inventions and patents, taken either singularly or in combination, is seen to describe the instant invention as claimed. Thus a process for the color recovery of vinyl plastics solving the aforementioned problems is desired.

SUMMARY OF THE INVENTION

The present invention is directed to a kit for cleaning a vinyl plastic surface. The kit includes a solvent mixture in a container and a cloth. Preferably, a fluorescent material is added to the solvent to restore brightness to the plastic vinyl surface.

Accordingly, it is a principal object of the invention to provide a method for improving the appearance of weathered and/or discolored vinyl plastics by removing dirt and grime.

It is another object of the invention to provide a method in which yellowing is counteracted by blue light without loss of reflectance.

It is an object of the invention to provide a kit for use in cleaning the surface of vinyl plastics for the purposes described which is inexpensive, dependable and fully effective in accomplishing its intended purposes.

These and other objects of the present invention will become readily apparent upon further review of the following specification.

DETAILED DESCRIPTION OF THE PREFERRED EMBODIMENTS

Figure 1:
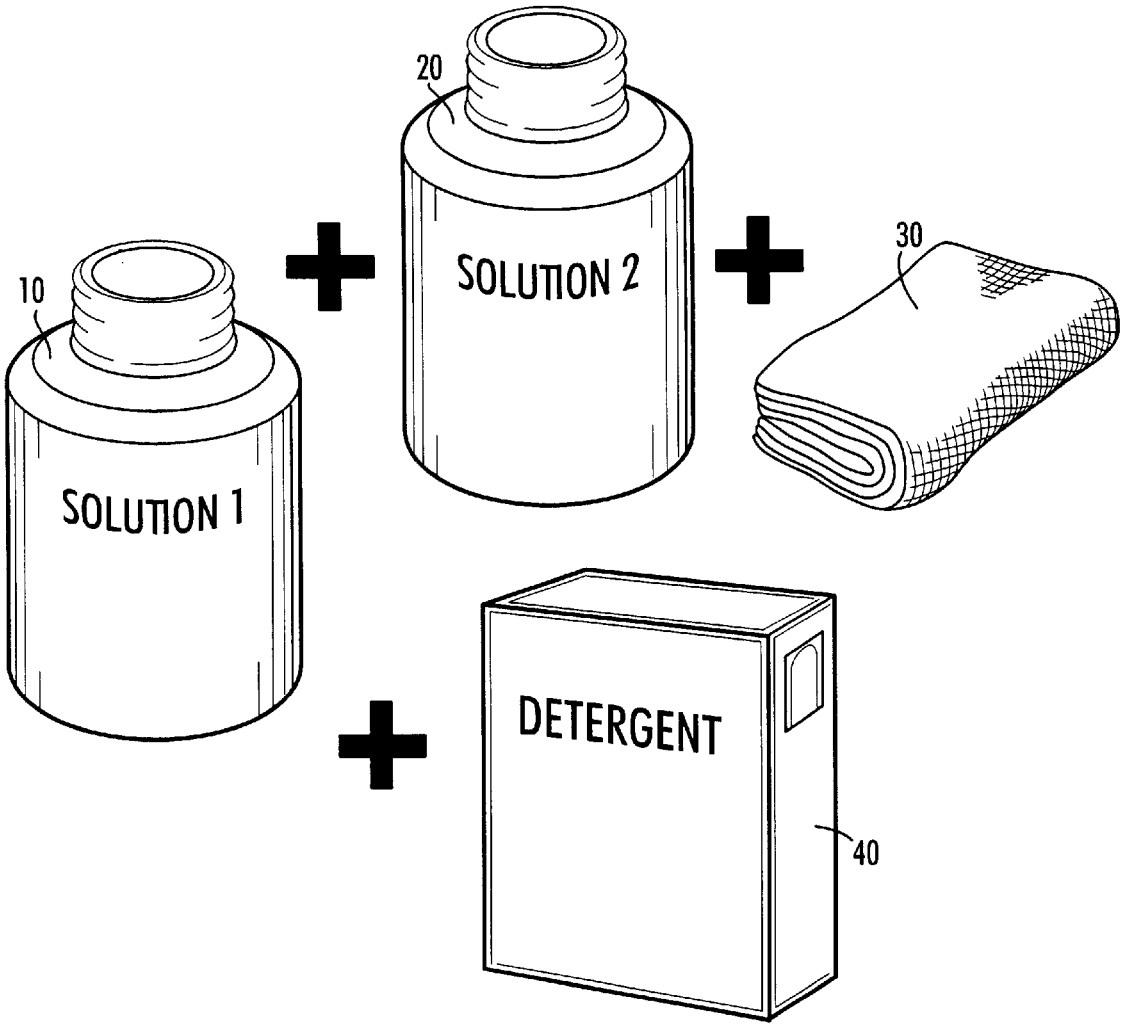
FIG. 1 is a diagram of the contents of the present kit, in a most preferred embodiment.

The present invention is a kit for cleaning vinyl plastics. The kit includes a first container containing a mild solvent mixture 10. Optionally, the solvent mixture in the first container can also include a fluorescent material to help restore brightness to the vinyl plastics. The kit may also include any one or more of the following: (a) a second container 20 containing a mixture of a solvent and a fluorescent material for white vinyl plastics to be applied as a coating; (b) a clean cloth 30 for applying the solvent mixture; and (c) a mild detergent 40 to remove easily removable dirt and grime from all vinyls prior to the application of the solvent mixture of the first container.

The present kit is used in the following manner: (a) cleaning the surface using the mild detergent; (b) drying the surface following (a); (c) applying the mild solvent mixture from the first container with the cloth to remove any accumulated films on the surface; and (d) drying the surface following (c). Optionally, for white vinyl plastics, the method includes the step of applying at least one coat of a mixture of the fluorescent material dissolved in solvent to the surface of white vinyl plastics.

The mild detergent used in step (a) is not in itself novel, and may advantageously include any commercially available detergent. Accordingly non-ionic, anionic, and/or cationic detergent may be formulated for use with the present process, or acquired in commercially available compositions such as those commonly used as dishwashing detergents. Cleaning should continue until all foreign particulate and fluid materials are removed.

The mild solvent mixture used in step (c) preferably includes alcohols, ethers, petroleum products and/or organic solvents of sufficient strength to remove accretionary soil films without damaging the vinyl surface. Accordingly, methanol, ethanol, propanol, butanol and/or a mixture of organic solvents may be used. Most preferably, these solvents are used in high dilution. Soil films, including those of solidified organic oils, may be removed in a plurality of applications of the solvent. The solvent mixture is kept in a first container.

Preferably, the solvent mixture in the first container includes a major portion of alcohol, isopropyl alcohol in particular, and at least one other solvent, preferably two solvents. The alcohol content should be at least 50% by volume and is preferably approximately 55%. The other solvents include primarily methyl ethyl ketone and, to a lesser extent, xylene. Preferably, methy ethyl ketone is present in an amount by volume less than 50% by volume, preferably at least 30% by volume to less than 50% by volume and most preferably, approximately 40%. Xylene is present in not more than approximately 5% by volume. These additional solvents increase cleaning strength and, correspondingly, cleaning time. Methy ethyl ketone and xylene are preferably kept below 50% of the total solvent mixture volume because they would otherwise tend to dissolve the plastic and result in streaking.

The solvent mixture of the first container is applied with the clean cloth by saturating a portion of the cloth with the mixture and then wiping the surface of the vinyl plastic until it is clean. After cleaning an area, the cloth is turned to reveal a clean section of cloth, which is then saturated for wiping another area. The term cloth of course could also refer to disposable paper toweling.

Drying steps (b) and (d) may be accomplished by ambient exposure for sufficient time to substantially remove all fluids from the vinyl surface. These steps may also be accelerated by any application of heat and/or air as desired.

A fluorescent solution to counteract any yellowing of the vinyl plastic surface includes a fluorescent agent which has at least a portion of its emissions in the violet/blue region of the visible spectrum dissolved in a solvent, preferably isopropyl alcohol. Accordingly, fluorescent agents which emit at wavelengths of from about 3.9×10-7 m to about 4.92×10-7 m may be used. Most preferably, the fluorescent agent is chosen to have absorption wavelengths in the UV region, thereby converting invisible radiant energy to visible violet and/or blue, without any appreciable decrease in luminous reflectance. Because the violet/blue region of visible color space is opposite the yellow region, yellowing is effectively counteracted. The fluorescent agents themselves are commercially available. The selection of an appropriate fluorescent agent from those available to meet the above criterion of emissions and optionally absorptions may be done using available spectral data of the agents. Appropriate fluorescent agents include UVITEX OB (thiophenediyl bis(tert-butylbenzoxazole)), stilbene, and stilbene derivatives. Most preferably, the fluorescent agent is a 0.001% by weight solution of UVITEX OB included in the solvent mixture contained in the first container for all plastics. The fluorescent material is dissolved in isopropyl alcohol for the second container and used for white vinyl plastics as a coating. In this second solution, in the second container, the concentration of the fluorescent material is 0.01% by weight. UVITEX OB is preferred as the fluorescent material for both because it is readily soluble in the solvents such as isopropyl alcohol.

The solution of the second container is applied with the clean cloth by moistening the cloth and then wiping a thin coat of the solution onto the plastic vinyl.

It is to be understood that the present invention is not limited to the embodiment described above, but encompasses any and all embodiments within the scope of the following claims.

What is claimed is:

1. A kit for cleaning vinyl, said kit comprising:

a container; and a mixture of isopropyl alcohol, methyl ethyl ketone and xylene in said container, wherein said isopropyl alcohol is at least approximately 55% of said mixture by volume.

2. The kit as recited in claim 1, further comprising a fluorescent material mixed with said mixture.

3. The kit as recited in claim 1, further comprising a cloth for applying said mixture to vinyl.

4. The kit as recited in claim 2, wherein said fluorescent material is present in said mixture at a concentration approximately 0.001% by weight.

5. The kit as recited in claim 1, wherein said methyl ethyl ketone is present in a greater proportion than said xylene.

6. The kit as recited in claim 1, wherein said methyl ethyl ketone is present in an amount of at least 30% by volume to less than 50% by volume.

7. The kit as recited in claim 1, wherein said xylene is present in an amount of approximately 5% or less by volume.

8. The kit as recited in claim 1, wherein said alcohol is approximately 55% of said mixture, said methy ethyl ketone is approximately 40% of said mixture and said xylene is approximately 5% of said mixture by volume.

9. The kit as recited in claim 1, wherein said fluorescent material is soluble in said mixture.

10. A kit for cleaning vinyl, said kit comprising:

a first container;

a mixture of isopropyl alcohol, methy ethyl ketone and xylene in said first container, wherein said methy ethyl ketone is less than 50% of said mixture by volume and said isopropyl alcohol is at least 50% of said mixture by volume; and a fluorescent material.

11. The kit as recited in claim 10, wherein said isopropyl alcohol comprises approximately 55% or more of said mixture by volume.

12. The kit as recited in claim 10, further comprising:

a second container; and a mixture of isopropyl alcohol and a fluorescent material in said second container.

13. The kit as recited in claim 10, wherein said fluorescent material in said first container is in a concentration of approximately 0.001% by weight.

14. The kit as recited in claim 12, wherein said fluorescent material in said second container is in a concentration of approximately 0.01% by weight.

15. The kit as recited in claim 10, further comprising a cloth for applying said mixture.

16. A kit for cleaning vinyl, said kit comprising:

a first container;

a mixture of isopropyl alcohol, methy ethyl ketone, xylene and a fluorescent material in said first container, wherein said isopropyl alcohol is at least 50% of said mixture by volume; and a cloth.

17. The kit as recited in claim 16, said kit further comprising:

a second container; and a mixture of isopropyl alcohol and a fluorescent material.

18. The kit as recited in claim 16, wherein said isopropyl alcohol constitutes approximately 55% of said mixture, said methy ethyl ketone comprises 40% of said mixture, and said xylene comprises 5% of said mixture by volume.

19. The kit as recited in claim 17, wherein said fluorescent material comprises not more than 0.001% by weight in said first container and 0.01% by weight in said second container.

* * * * *